US005083397A

United States Patent [19]

Koura

[11] Patent Number: 5,083,397

[45] Date of Patent: Jan. 28, 1992

[54] AUTOMATIC DOOR OPERATING SYSTEM

[75] Inventor: Soushichi Koura, Yokohama, Japan

[73] Assignee: Ohi Seisakusho Co., Ltd., Yokohama, Japan

[21] Appl. No.: 618,477

[22] Filed: Nov. 27, 1990

[30] Foreign Application Priority Data

Nov. 27, 1989 [JP] Japan ..... 1-136084[U]

[51] Int. Cl.[5] ..... E05F 15/00

[52] U.S. Cl. ..... 49/28; 49/139; 49/280; 49/360

[58] Field of Search ..... 49/28, 280, 139, 360

[56] References Cited

U.S. PATENT DOCUMENTS 4,561,691 12/1985 Kawai et al. ..... 49/28 X
4,640,050 2/1987 Yamagishi et al. ..... 49/280
4,855,653 8/1989 Lemirande ..... 49/28 X
4,862,640 9/1989 Boyko et al. ..... 49/280 X
4,887,205 12/1989 Chou ..... 49/28 X

*Primary Examiner*—Philip C. Kannan
*Attorney, Agent, or Firm*—Foley & Lardner

[57] ABSTRACT

In an automatic door operating system, there is employed a so-called fail-safe means which controls a door closing device. The door closing device functions to enforcedly shift the door from its half-latch position to its full-close latched position. The fail-safe means is so arranged as to deal with such a possible undesirable matter that due to, for example, a foreign thing accidentally caught between the door and the vehicle body, the door is forced to stop during its shifting from the half-latch position to the full-close latched position. Upon this door stopping, a control switch is turned in the other direction by an operator (viz., driver). With this, the door closing device is operated in a reversed manner for a time given by a timer, so that the door is moved back to a position near the half-latch position thereby to facilitate the removal of the foreign thing.

9 Claims, 2 Drawing Sheets

AUTOMATIC DOOR OPERATING SYSTEM

BACKGROUND OF THE INVENTION

1. Field of the Invention

The present invention relates in general to an automatic door operating system for use in a motor vehicle, and more particularly, to an automatic slide door operating system in which the opening and closing movement of the door is carried out with the aid of a power device upon manipulation of a control switch.

2. Description of the Prior Art

Hitherto, in motor vehicles, particularly, in so-called "one-box" type motor vehicles having slide doors, various types of power systems have been proposed and put into practical use for opening and closing the door with the aid of a power device. One of such systems is disclosed in U.S. patent Application No. 07/526,653 filed on May 22, 1990 in the names of Soushichi KOURA et al.

The power system disclosed in the U.S. patent Application comprises a door moving device which is mounted on a vehicle body for moving the slide door in both directions to open and close a door opening defined by the vehicle body, a door closing device which is mounted on the door for enforcedly shifting the door to a full-close latched position when the door comes to a half-latch position, a latch cancelling device which is mounted on the door for cancelling the latched condition of the door just before starting of the door opening operation of the door moving device, and a control switch which is mounted near a driver's seat or the door opening for controlling the operation of these devices.

That is, when, with the slide door assuming an open position, the control switch is manipulated to pivot in one direction, the door moving device moves the door to the half-latch position and then the door closing device shifts the door to the full-close latched position.

When, thereafter, the control switch is manipulated to pivot in the other direction, the latch cancelling device cancels the latched condition of the closed door and thereafter the door moving device moves the unlatched door from the closed position toward the open position.

The door moving device and the door closing device are equipped with respective electric motors for producing motive power. The reason of usage of such door closing device in addition to the door moving device is that the shifting of the door from the half-latch position to the full-close latched position needs a great force because of a considerable resistance offered by an elastomeric door seal under such movement. In fact, the door shifting from the half-latch position to the full-close latched position is not achieved by only the power produced by the door moving device. That is, when the door is moved to the half-latch position by the door moving device, the door closing device starts its operation to shift the door from the half-latch position to the full-close latched position.

In the power system of the U.S. patent application, there is further employed an electric power feeding system for feeding an electric power from an electric power source mounted on the vehicle body to the closing device mounted on the door.

The power feeding system comprises an electric connector which includes a first connector part mounted to the vehicle body and a second connector part mounted to the door. The second connector part is brought into engagement with the first connector part when the door, during its closing movement, comes to a so-called "half-latch available position" which is near the full-close latched position of the door. The power feeding system further comprises a so-called "feeding start position detecting switch" which is mounted to the vehicle body. The switch completes the electric circuit from the electric power source to the first connector part when the door, during its closing movement, comes to a so-called "feeding start position" which is near the half-latch available position.

However, the power system described hereinabove has the following drawback.

That is, when, due to, for example, presence of a foreigh thing accidentally caught between the door and the vehicle body, the door is forced to stop at a position between the half-latch position and the full-close latched position during its closing movement, the control switch should be-manipulated to pivot in the opposite direction for stopping the power feeding to the motor of the door closing device. However, due to its inherent construction, when the control switch is released from the operator's finger, the switch is returned to the originally set position causing restarting of the power feeding to the motor. This causes a troublesome work for removing the foreign thing from such narrow space of the vehicle. In fact, the work for removing the foreign thing should be carried out by having the control switch kept pushed.

SUMMARY OF THE INVENTION

It is therefore an object of the present invention to provide an automatic door operating system which is free of the above-mentioned drawback.

According to the present invention, there is provided an automatic door operating system which is equipped with a fail-safe means which can deal with such a possible undesirable matter that due to, for example, a foreign thing accidentally caught between the door and the vehicle body, the door is forced to stop during its shifting from the half-latch position to the full-close latched position.

According to the present invention, there is provided an automatic door operating system for use in a motor vehicle having a vehicle body and a movable door. The system comprises first means for allowing the door to assume an open position, a half-latch position and a full-close latched position, the opening position being a position wherein the door opens a door opening defined by the vehicle body, the half-latch position being a position wherein the door is halfly latched to the vehicle body while almost closing the door opening and the full-close latched position being a position wherein the door is fully latched to the vehicle body while fully closing the door opening; an electric door moving device for moving the door between the open position and the half-latch position when energized; an electric door closing device for shifting the door from the half-latch position to the full-close latched position when energized; a latch cancelling device for cancelling, when energized, the latched condition of the door in the full-close latched position; a control device for controlling the electric door moving device and the latch cancelling device, the control device including first and second switch means, the control device permitting the opening and closing movements of the door when the first and second switch means are selectively closed, the control device permitting energization of the latch cancelling device when the first switch means is closed; and a fail-safe means for eliminating a possible trouble which may occur when the door is actuated by the electric door closing device.

DETAILED DESCRIPTION OF THE DRAWINGS

Figure 1:
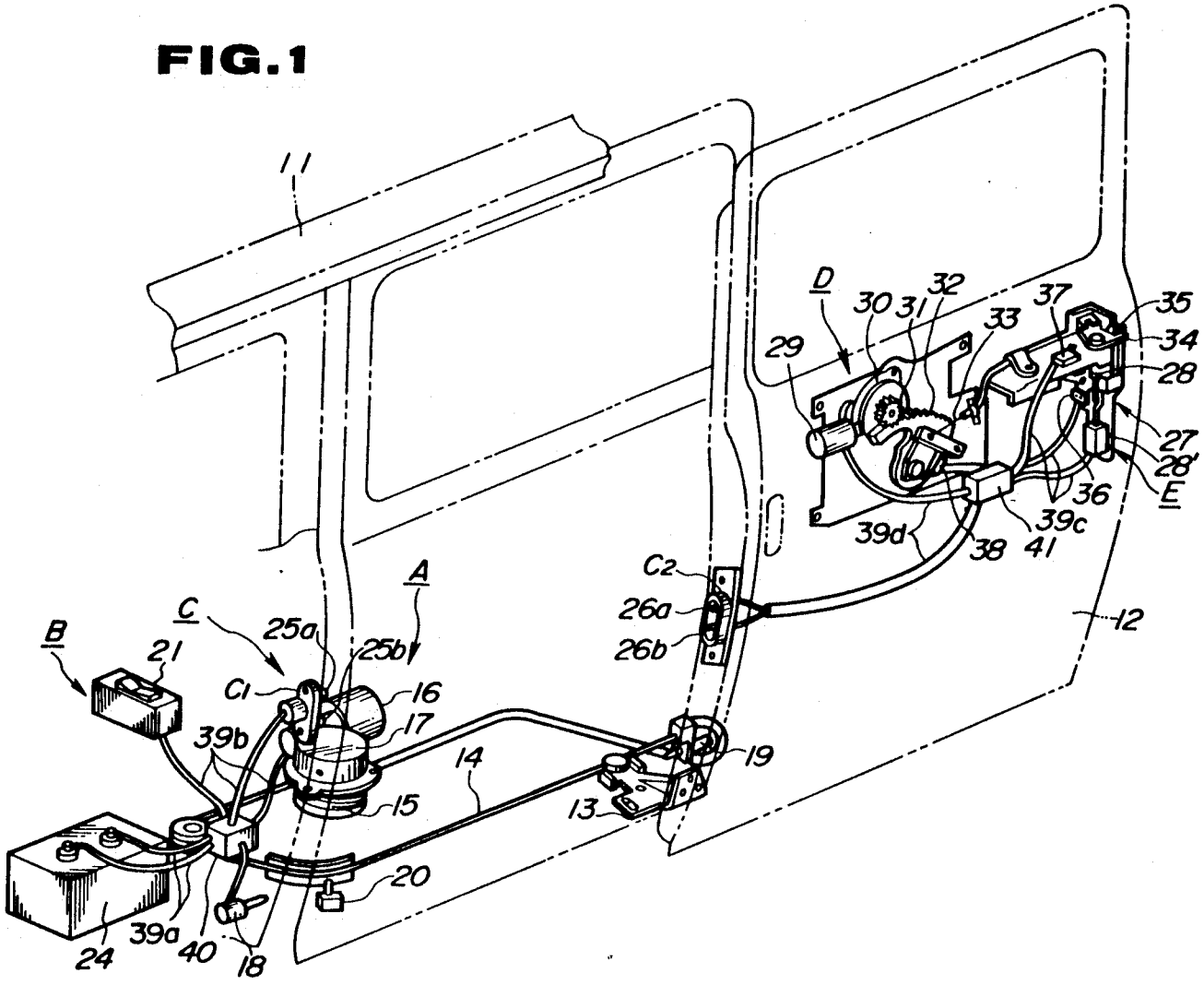
Figure 2:
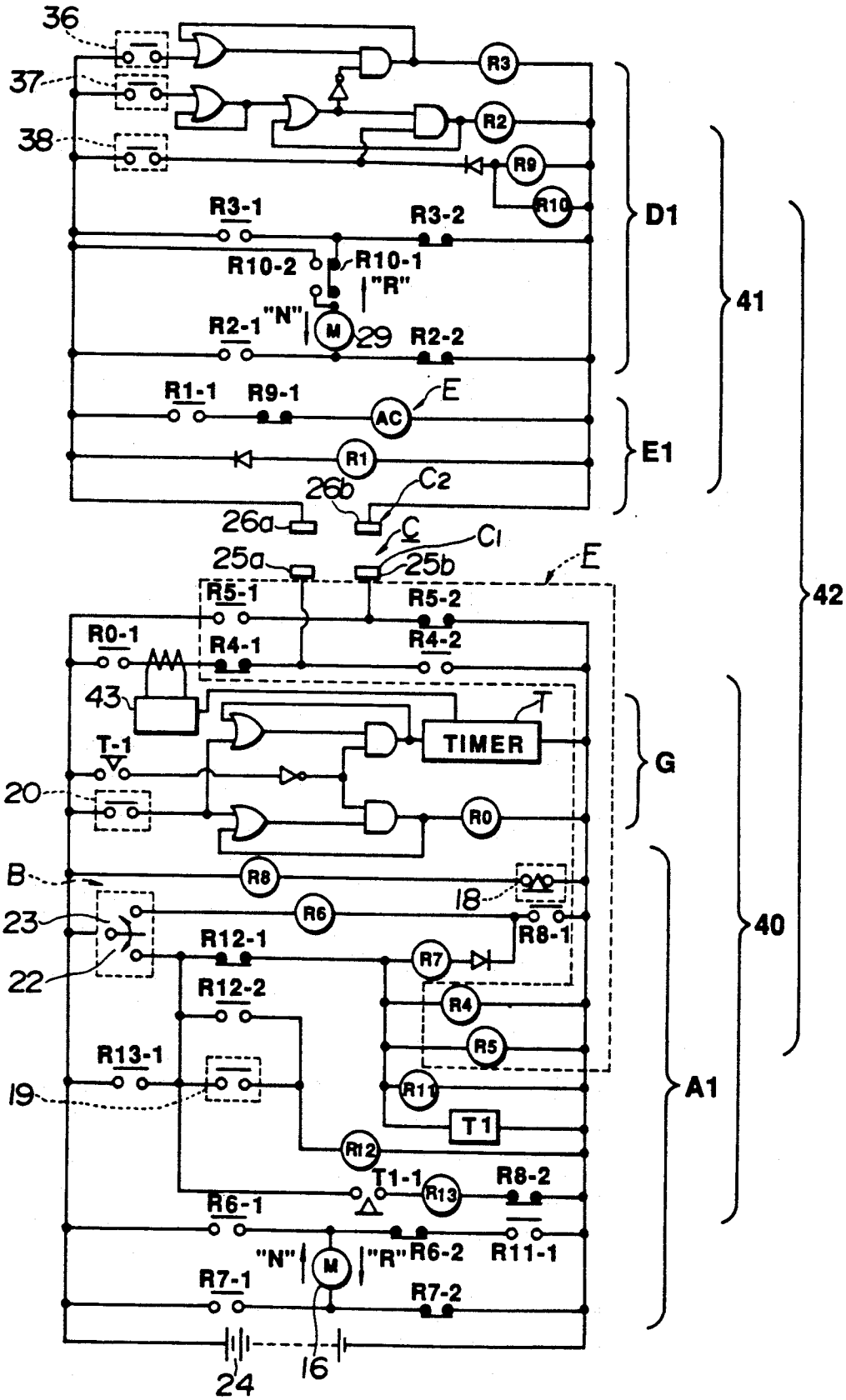

Other objects and advantages of the present invention will become apparent from the following description when taken in conjunction with the accompanying drawings, in which:

FIG. 1 is a perspective view of a power slide door to which the present invention is applied; and FIG. 2 is a control circuit employed in the present invention.

DETAILED DESCRIPTION OF THE INVENTION

Referring to FIG. 1, there is shown a power slide door of a motor vehicle, to which the present invention is applied.

In the drawings, denoted by numeral 11 is a vehicle body, and denoted by numeral 12 is a slide door. Although not shown in the drawing a known door guide structure is employed by which a guide for the door 12 is defined. That is, under door opening operation, the door 12 in the full-close position is shifted laterally outward and then moved rearward toward the full-open position. The movement of the door 12 from the full-open position to the full-close position is carried out by taking a reversed manner.

As is shown in the drawing, at a lower portion of the vehicle body 11, there is arranged a door moving device "A" by which the door 12 is driven between the full-close and full-open positions travelling along the guide way defined by the door guide structure.

The door moving device "A" is described in U.S. Pat. No. 4,640,050. The device "A" will be briefly described in the following with reference to FIG. 1.

A bracket 13 is secured to a lower front portion of the door 12. The bracket 13 has a drive cable 14 fixed thereto, which cable has a part extending along the guide way for the door 12. The cable 14 has both end portions wound around a drive drum 15. The drum 15 is driven by a reversable electric motor 16 through a speed reduction gear 17. Thus, upon energization of the motor 16, the drive drum 15 is rotated in one or the other direction to move the slide door 12 in opening or closing direction along the door guide way.

The door moving device "A" is controlled by a door-close detectiing switch 18 and a door-open detecting switch 19. The door close detecting switch 18 is of a normallyn closed type, which is mounted on the vehicle body and turned OFF when the door 12 assumes a position between the full-close latched position and an after-mentioned half-latch position. For this operation, the switch 18 has an antenna pin which is contactable with a front end of the door 12. The door-open detecting switch 19 is of a normally open type, which is mounted on the vehicle body 11 and turned ON when the door 12 comes to the full-open position. For this operation, the switch 19 has an antenna pin which is contactable with a rear end of the bracket 13 of the door 12.

The vehicle body 11 has a so-called "feeding start position detecting switch" 20 mounted thereon. The switch 20 is of a normally open type and so constructed as to close for a moment only when the front end of the slide door 12, during its close movement, passes by a so-called "feeding start position" which is near a so-called "half-latch available position" where the door 12 can assme an after-mentioned half-latch condition. It is to be noted that when the front end of the door 12 assumes the feeding start position, there is defined a small clearance between the front end of the door 12 and a front end of the door opening, which clearance is so sized as not to permit insertion of an operator's hand therethrough. More specifically, the clearance is somewhat larger than a clearance which is defined when the door 12 assumes the half-latch available position.

Designated by reference "B" is a control device which is mounted on the vehicle body 11 at a position near the driver's seat. The controlling device "B" comprises a seesaw type button switch 21.

As will be seen from FIG. 2, the button switch 21 comprises one movable contact and two stationary contacts. The movable contact and one stationary contact constitute a so-called "door opening control switch" 22, while, the movable contact and the other stationary contact constitute a so-called "door closing control switch" 23. That is, when the button is pivoted in one direction, the switch 22 is closed, while, when the button is pivoted in the other direction, the other switch is closed.

Referring back to FIG. 1, designated by numeral 24 is a battery which serves as an electric power source.

Designated by reference "C" is an electric connector which comprises mutually engageable first and second connector parts C1 and C2 each including two axially movable contact pins **25*a* and 25*b* (or 26*a* and 26*b***). Each contact pin is biased to project by a spring associated therewith.

The first connector part C1 is mounted on a front end of the door opening having the contact pins **25*a* and 25*b* directed rearward and the second connector part C2 is mounted on the front end of the slide door 12 having the contact pins 26*a* and 26*b*** directed forward.

The first and second connector parts C1 and C2 are engaged to establish an electric connection therebetween when the door 12 closes. More specifically, when the slide door 12 assumes a position between the feeding start position and the full-close position, the contact pins **25*a* and 25*b* of the first connector part C1 and the corresponding contact pins 26*a* and 26*b* of the second connector part C2 are mated. Thus, under this condition, electric power feeding from the battery 24 on the vehicle body 11 to after-mentioned electric devices in the slide door 12** is available.

The contact pins **25*a* and 25*b* of the first connector part C1, the motor 16, the door-close detecting switch 18, the door-open detecting switch 19, the control device "B", the feeding start position detecting switch 20 and the battery 24 are connected through suitable lead wires 39*a* and 39*b* to a body-mounted control unit 40**.

Within the slide door 12, there is mounted a door closing device "D" which functions to shift the door 12 from the half-latch position to the full-close position.

That is, as will be described in detail hereinafter, when the door 12 comes to the half-latch available position, a latch pawl (not shown) of a door lock device 27 becomes incompletely or halfly engaged with a striker (not shown) secured to the vehicle body 11, and thereafter, due to the work of the door closing device "D", the latch pawl is forced to turn to achieve a complete engagement with the striker enforcedly shifting the door 12 to the full-close latched position.

Within the slide door, there is further mounted a latch cancelling device "E" which, upon energization, cancels the latched condition of the slide door 12 in the full-close position. For achieving this cancelling operation, the latch cancelling device "E" has an open lever 28 incorporated with the door lock device 27 and a solenoid-spring combination type actuator 28' incorporated with the open lever 28. That is, upon energization of the actuator 28', the open lever 28 is pulled in a direction to cancel the latched condition of the door lock device 27. Thus, the slide door 12 becomes unlatched and thus thereafter, the opening movement of the slide door 12 becomes available.

The door closing device "D" is disclosed in U.S. patent application No. 07/287,277 filed Dec. 21, 1988 in the name of Jun YAMAGISHI et al.

The device "D" comprises an electric motor 29, a speed reduction gear 30 driven by the motor 29, a pinion 31 driven by an output shaft of the reduction gear 30 and a sector gear 32 meshed with and thus driven by the pinion 31.

When the motor 29 is energized to run in a normal direction, the sector gear 32 pivots in a counterclockwise direction in FIG. 1 thereby pulling a cable 33 which leads to a close lever 34. With this movement, the close lever 34 is pivoted in one direction to move the latch pawl of the door lock device 27 to the full-latch position. With this, the slide door 12 is forced to shift from the half-latch position to the full-close latched position. Designated by numeral 35 is is an arm possessed by the latch pawl, against which the close lever 34 actually abuts for the movement of the latch pawl.

When, thereafter, the motor 29 is energized to run in a reversed direction, the sector gear 32 and thus the close lever 34 are moved in the other directions, and finally, they are returned to their original positions. The close lever 34 stops at a position remote from the arm 35 of the latch pawl. It is to be noted that under this condition, the full-close latched condition of the door 12 is kept unchanged.

Designated by numeral 36 is a half-latch detecting switch mounted to the door lock device 27, which functions to detect the arrival of the door 12 to the half-latch available position. That is, the switch 36 is turned ON when, upon abutment of the striker against the latch pawl due to the arrival of the door 12 to the half-latch available position, the open lever 28 is slightly turned in the lock cancelling direction.

Designated by numeral 37 is a full-latch detecting switch which is mounted to the door lock device 27. The switch 37 functions to detect the fully-latched condition of the door lock device 27. That is, the switch 37 is turned ON when the close lever 34 abuts on the switch 37 turning the latch pawl to the fully-latched position.

Designated by numeral 38 is a so-called "return recognition switch" which detects whether the sector gear 32 has returned to a rest position or not. The switch 38 is kept OFF when the sector gear 32 is in the rest position as shown in FIG. 1, but turned ON when the sector gear 32 is pivoted away from the rest position.

The motor 29, the half-latch detecting switch 36, the half-latch detecting switch 36, the full-latch detecting switch 37, the return recognition switch 38 and the actuator 28' are connected through suitable lead wires **39*c* to a door mounted control unit 41. The contact pins 26*a* and 26*b* of the second connector part C2 are connected to the control unit 41 through lead wires 39*d***, as shown.

FIG. 2 shows a control circuit 42 employed for controlling the door 12 in the present invention.

The control circuit 42 comprises generally the body-mounted control unit 40 and the door-mounted control unit 41.

The body-mounted control unit 40 comprises a control device "Al" which controls the door moving device "A", a positive/negative switching device "F" which switches the polarity of electric power fed to the contact pins **25*a* and 25*b* of the first connector part C1 in response to operation of the control device "B", and a time-counting device "G" which controls, by using a timer "T", the time for which electric power feeding is kept made during closing movement of the door 12**.

The door-mounted control unit 41 comprises a control device "Dl" which controls the door closing device "D" and a control device "El" which controls the latch cancelling device "E".

Denoted by references R0, R1, R2, . . . . R13 are relays, R0-1, R1-1, R2-1, . . . R13-1 are contacts of the relays, T-1 and T1-1 are timer contacts of the timers T and T1, and denoted by numeral 43 is a current detector which resets the timer T1 when detecting that a predetermined current sufficient for operating motor 29 flows through a series circuit which includes the contacts R0-1 and R4-2. AND gates, OR gates, inverters and diodes are arranged in respective circuits in the illustrated manner.

In the control circuit 42 shown in FIG. 2, the timer contact T1-1 of the timer T1 is connected in series with a circuit including the door opening control switch 22, the relay 13 and the contact R8-2. The timer T1 is energized when the switch 22 is closed and when, due to positioning of the door 12 between the full-close latched position and the half-latch position, both the door close and open detecting switches 18 and 19 assume their OFF positions causing ON condition of the contacts R8-2 and R12-1. Upon energization of the timer T1, the timer contact T1-1 completes the circuit for a given time.

Upon closing of the contact T1-1, the relay R13 becomes energized and thus the contact R13-1 becomes closed. The closed condition of the contact R13-1 is kept for a given time. It is to be noted that keeping the closed condition of the contact R13-1 for the given time is like a condition wherein the switch 22 is kept closed for the given time.

In the following, operation of the automatic door operating system of the invention will be described with reference to FIGS. 1 and 2.

For ease of understanding, the description will be commenced with respect to the full-close latched condition of the slide door 12. Under this condition, the first and second connector parts C1 and C2 are engaged, the control device "B" (viz., the button switch 21) assumes a neutral position, the door-close detecting switch 18 is opened, the full-latch detecting switch 37 is closed, the normally open switches are all opened, the normally closed switches are all closed and the relays are all deenergized.

When, now, the door opening control switch 22 of the control device "B" is closed by, for example, a driver in the vehicle, the relays R4, R5, R11 and the timer T1 are simultaneously energized.

With this, the relay R13 becomes energized causing the contact R13-1 to keep its closed condition for a time given by the timer T1, the normally open switches R4-2, R5-1 and R11-1 are closed and the normally closed switches R4-1 and R5-2 are opened. Upon this, the electric power feeding to the electric connector C becomes available having the contact pins 25*a* and 26*b* charged negative and positive respectively.

Because the first and second connector parts C1 and C2 are kept coupled, the electric power is applied to the door-mounted control unit 41. Thus, a circuit consisting of the contact 25*b*, the relay R1, the diode (no numeral) and the contact 25*a* becomes completed thereby energizing the relay R1.

Upon this, the contact R1-1 is closed and thus the latch cancelling device "E" is energized. Thus, the open lever 28 of the door lock device 27 is turned in a direction to cancel the latched condition of the door 12, so that the door 12 is forced to move to the half-latch available position due to the biasing force produced by the elastomeric door seal.

Upon this, the door-close detecting switch 18 is closed energizing the relay R8. With this, the relay R7 is energized because the door open control switch 22 is kept closed, so that the contact R7-1 is closed and the contact R7-2 is opened. Thus, a circuit including the contact R7-1, the motor 16, the contact R6-2 and the contact R11-1 becomes completed causing the motor 16 to run in a normal direction.

Due to the running of the motor 16 in the normal direction, the door 12 starts to move in the door opening direction. That is, the door 12 becomes driven by the door moving device "A".

When the door 12 passes by the "feeding start position", the second connector part C2 of the door 12 is separated from the first connector part C1 of the vehicle body 11 stopping the electric power feeding to the electric devices in the door 12. Thus, the relay R1 is deenergized, the operation of the actuator 28' of the latch cancelling device "E" stops, and thus, the open lever 28 is returned to its original rest position.

Thereafter, due to continuous operation of the door moving device "A", the door 12 is continuously moved in the opening direction.

When then the door 12 comes to the full open position, the door-open detecting switch 19 is closed.

With this, the relay R12 becomes energized closing the contact R12-2 and opening the other contact R12-1, so that the relays R7, R4, R5 and R11 are all deenergized causing their contacts to return to their original positions. Thus, the motor 16 becomes deenergized. At the same time, the power feeding circuit leading from the battery 24 to the first connector part C1 is blocked.

It is to be noted that the above-mentioned operation is carried out with the door opening control switch 22 kept closed.

When now the door closing control switch 23 is closed, the relay R6 becomes energized. It is to be noted that under such condition, the door close detecting switch 18 is closed and thus the relay R8 is energized.

Upon energization of the relay R6, the contact R6-1 is closed, the other contact R6-2 is opened, and a circuit including the contact R6-1, the motor 16 and the contact R7-2 is completed. Thus, the motor 16 is operated to run in a reversed direction.

Thus, the door 12 is moved in the closing direction.

When the door 12 comes to the "feeding start position", the second connector part C2 of the door 12 is brought into engagement with the first connector part C1 of the vehicle body 11 and, at the same time, the feeding start position detecting switch 20 is closed for a moment.

Upon this, the relay R0 and the timer T are energized and thus they are brought to their self-holding conditions.

When, due to energization of the relay R0, the contact R0-1 is closed, the contact pin 25*a* of the first connector part C1 is connected through the contacts R0-1 and R4-1 to the positive terminal of the battery 24 (viz., electric power source), and the other contact pin 25*b* is connected through the contact R5-2 to the negative terminal of the battery 24. Thus, a circuit from the battery 24 to the electric connector C is completed in such a manner that the contact pins 25*a* and 25*b* are charged positive and negative respectively, unlike the above-mentioned case wherein the door 12 is being opened.

The timer T is so constructed that when a predetermined time (for example, ten seconds) passes after energization thereof, the timer contact T-1 is closed.

When, due to, for example, presence of a foreign thing accidentally caught between the door 12 and the vehicle body 11, the door 12 is forced to stop at a position between the feeding start position and the half-latch available position and the predtermined time passes, the timer contact T-1 is closed and thus the relay R0 is deenergized. Thus, thereafter, electric power feeding toward the electric connector C stops and electric power feeding to the timer T also stops. Thus, waste of electric power is suppressed.

When, within the predetermined time, the motor 29 of the door closing device "D" is operated in an aftermentioned manner and thus a certain degree of current flows through the series circuit which includes the contact R0-1 and the contact R4-2, the current detector 43 detects the current and thus resets the timer T. Thus, thereafter, the timer T starts the time counting again.

Accordingly, even when the motor 29 starts its operation just before the time when the predetermined time elapses, instant deenergization of the relay R0 does not occur and thus instant stop of power feeding to the motor 29 does not occur. That is, from the time when the timer T is reset, electric power feeding to the door-mounted electric devices is continued for a time which is sufficient for operating the motor 20 to accomplish the shifting of the slide door 12 from the half-latch position to the full-close latched position.

Even when the operation of the motor 29 is continued for a considerably longer time because, for example, a foreign thing has been accidentally caught between the door 12 and the vehicle body 11, the operation of the motor 29 stops at the time when the predetermined time set by the timer T elapses. Thus, safety of the motor 29 is assured. That is, upon expiration of the predetermined time, the timer contact T1 of the timer T is closed and thus the relay R0 is deenergized causing deenergization of the motor 29.

When, after starting of the electric power feeding to the door-mounted electric devices, the door 12 is moved to the half-latch available position due to the continuous work of the door moving device "A", the door closing detecting switch 18 is opened and at the same time the half-latch detecting switch 36 is closed.

Upon opening of the door closing detecting switch 18, the relay R8 is deenergized causing the contact R8-1 to open. Thus, the relay R6 is deenergized.

With this, the contact R6-1 is opened and the other contact R6-2 is closed, so that the operation of the motor 16 stops and thus the closing movement of the door 12 effected by the door moving device "A" stops.

At substantially the same time as the stop timing of the door moving device "A", the half-latch detecting switch 36 of the door closing device control device D1 is closed. Upon this, the relay R3 is energized and kept in a self-holding condition.

Upon this, the contact R3-1 is closed, the contact R3-2 is opened and a circuit including the contact R3-1, the contact R10-1, the motor 29 and the contact R2-2 is completed thereby operating the motor 29 in a normal direction.

With the rotation of the motor 29 in the normal direction, the sector gear 32 of the door closing device "D" is pivoted in a counterclockwise direction in FIG. 1. Thus, the the cable 33 is pulled leftward turning the close lever 34. With this, the latch pawl of the door lock device 27 is forced to achieve a complete engagement with the striker thereby to shift the door 12 to the full-closed latched position. It is to be noted that the shifting of the door 12 is achieved by only the door closing device "D".

When the sector gear 32 is pivoted in a counterclockwise direction in FIG. 1 from the rest position, the return recognition switch 38 is closed. However, this closing of the switch 38 has no effect on the relays.

When the latch pawl of the door lock device 27 is turned to the full-latch position, the full-latch detecting switch 37 is closed thereby deenergizing the relay R3 and energizing the relay R2.

With this, the contacts R3-1 and R2-2 are opened and the contacts R2-1 and R3-2 are closed, so that a circuit including the contact R2-1, the motor 29, the contact R10-1 and the contact R3-2 is completed thereby operating the motor 29 to run in a reversed direction.

With this reversed operation of the motor 29, the sector gear 32 is pivoted in a clockwise direction in FIG. 1 and returned to the rest position.

When the sector gear 32 is returned to the rest position, the return recognition switch 38 is closed deenergizing the relay R2. With this, the contact R2-1 is opened and the contact R3-2 is closed, so that the energization of the motor 29 stops. Thus, the operation of the motor 29 stops.

When, thereafter, the predetermined time set by the timer T elapses, the relay R0 is deenergized causing the contact R0-1 to open. With this, the electric power feeding toward the electric connector C stops. Thus, the door 12 now assumes the full-closed latched position.

In the following, operation of the automatic door operating system of the invention will be described with respect to a condition wherein during the operation of the door closing device "D", a foreign thing is accidentally caught between the door 12 and the vehicle body 11.

When, during closing movement, the door 12 comes to the half-latch available position, the half-latch detecting switch 36 is closed. With this, as has been described hereinabove, the motor 29 of the door closing device "D" is operated to run in the normal direction and thus the door 12 is shifted toward the door close latched position.

However, if a foreign thing has been caught between the door 12 and the vehicle body 11, the shifting of the door 12 to the door close latched position is not achieved.

In this case, the door opening control switch 22 of the control device "B" is closed by an operator. It is to be noted that this switch closing may be momentary.

With this momentary closing, the relays R4, R5 and R11 are all energized simultaneously and, at the same time, the timer T1 is also energized causing the contact T1-1 to close. Thus, the relay R13 is energized causing the contact R13-1 to close.

Since the relay R13 is kept energized for the time determined by the timer T1 (that is, the time for which the contact T1-1 keeps closed), the closed condition of the contact R13-1 is held for the time. This means that the energization of the relays R4, R5 and R11 is kept for the time.

Accordingly, for the predetermined time, the electric power feeding to the electric connector C is so controlled that the contact pins 25*a* and 25*b* of the first connector part C1 are charged negative and positive respectively in order that the door closing device "D" operates in a reversed manner and the latch cancelling device "E" operates in a manner to cancel the latched condition of the door lock devick 27.

During this time, the first connector part C1 and the second connector part C2 are kept engaged keeping the electric power feeding to the door-mounted electric devices. Furthermore, since the sector gear 32 of the door closing device "D" is kept away from the rest position, the return recognition switch 38 is closed thereby energizing the relays R9 and R10.

Thus, under this condition, the contact R9-1 is opened, the contact R10-1 is opened and the contact R10-2 is closed, and thus a circuit including the contact R2-2, the motor 29 and the contact R10-2 is completed causing an instant running of the motor 29 in the reversed direction. Thus, within the predetermined time, the sector gear 32 and its incorporated parts are returned to their rest positions.

When the sector gear 32 comes to the rest position, the return recognition switch 38 is opened causing deenergization of the relays R9 and R10. Upon this, the contact R9-1 is closed, the contact R10-2 is opened and the contact R10-1 is closed, so that energization of the motor 29 stops and thus the operation of the motor 29 in the reversed direction stops.

During the above-mentioned operation, the electric power feeding toward the electric connector "C" is continued causing energization of the relay R1 and thus closing of the contact R1-1. Thus, a circuit including the latch cancelling device "E", the contact R9-1 and the contact R1-1 is completed causing the latch cancelling device "E" to operate, and thus, the latched condition of the door lock device 27 is cancelled. Thus, thereafter, the door 12 can be moved but slightly in the door opening direction. This slight movement of the door 12 facilitates the work for removing the foreign thing from the space between the door 12 and the vehicle body 11.

When, thereafter, the time determined by the timer T1 elapses, the contact T1-1 is opened causing deenergization of the relay R13 and thus opening the contact R13-1. Thus, electric feeding toward the electric connector "C" stops.

What is claimed is:

1. An automatic door operating system for use in a motor vehicle having a vehicle body and a movable door, comprising:

door guide means for allowing said door to assume an open position, a half-latch position and a full-close latched position, said open position being a position wherein said door opens a door opening defined by said vehicle body, said half-latch position being a position wherein said door is partly latched to the vehicle body while almost closing said door opening and said full-close latched position being a position wherein said door is fully latched to the vehicle body while fully closing said door opening;

an electric door moving device for moving said door between said open position and said half-latch position when energized;

an electric door closing device for shifting said door from said half-latch position to said full-close latched position when energized;

a latch cancelling device for cancelling, when energized, the latched condition of said door in the full-close latched position;

a control device for controlling said electric door moving device and said latch cancelling device, said control device including a first and second switch devices, said control device permitting the opening and closing movements of said door when said first and second switch devices are selectively closed, said control device permitting energization of said latch cancelling device when said first switch device is closed; and a fail-safe means for eliminating a possible trouble which may occur when said door is actuated by said electric door closing device, said fail-safe means including operating means for operating, when assuming a given condition, said door closing device in a reversed manner and operating said latch cancelling device; a timer for causing, when energized, said operating means to assume said given condition for a given time; and starter means for starting said timer when said first switch device is closed while said door closing device is operating for shifting said door toward said full-close latched position.

2. An automatic door operating system as claimed in claim 1, in which said timer is connected in series with said first switch device.

3. An automatic door operating system as claimed in claim 2, in which said operating means comprises:

a relay which, when energized, changes the polarity of electric power applied to an electric motor of said door closing device; and another relay which, when energized, completes a circuit from an electric power source to an electric actuator of said latch cancelling device.

4. An automatic door operating system as claimed in claim 3, in which said control device comprises:

a door-close directing switch which is connected to said door moving device and turned OFF when said door comes to said full-close latched position;

a door-open detecting switch which is connected to said door moving device and turned ON when said door comes to a position to fully open the door opening;

wherein said second switch device and said door-close detecting switch are connected in series so that when these switches are both closed, said door moving device is operated to move said door in the closing direction.

5. An automatic door operating system as claimed in claim 4, in which said control device further comprises:

a feeding start position detecting switch which is closed for a moment when said door, during its closing movement, passes by a feeding start position which is near said half-latch position; and timer means for limiting the period of time for which said door closing device is energized.

6. An automatic door operating system as claimed in claim 5, in which said control device further comprises:

a current detector which issues an information signal when said door closing device is energized; and stop control means which breaks the electric connection between said door-close detecting switch and said second switch device when said current detector issues said information signal.

7. An automatic door operating system as claimed in claim 6, in which said door guide means comprises:

a door guide structure by which said door is slidably movable along a side surface of the vehicle body; and a door lock device for incompletely and completely latching said door relative to said vehicle body.

8. An automatic door operating system as claimed in claim 7, in which each of said door moving device and said door closing device employs an electric motor as a motive power generator.

9. An automatic door operating system as claimed in claim 8, in which said door lock device comprises:

a latch pawl pivotally connected to said door; and a striker secured to said vehicle body, said latch pawl being latchingly engageable with said striker.

* * * * *